US005555615A

United States Patent [19]

Salli

[11] Patent Number: 5,555,615

[45] Date of Patent: Sep. 17, 1996

[54] MODULAR WIRE FRAME TABLE AND METHOD OF ASSEMBLY

[75] Inventor: Carl Salli, Round Rock, Tex.

[73] Assignee: Advanced Micro Devices Inc., Sunnyvale, Calif.

[21] Appl. No.: 407,708

[22] Filed: Mar. 21, 1995

[51] Int. Cl.[6] ..... B23P 25/00

[52] U.S. Cl. ..... 29/458; 29/469; 108/181; 108/156; 211/181; 211/153

[58] Field of Search ..... 108/180, 181, 108/186, 192, 153, 156; 211/181, 153, 188, 134; 29/458, 527.2, 525.11, 469

[56] References Cited

U.S. PATENT DOCUMENTS 5,163,373 11/1992 Anderson et al. ..... 108/156

FOREIGN PATENT DOCUMENTS 857774 12/1970 Canada ..... 108/180
1425784 12/1965 France ..... 108/153
1076243 7/1967 United Kingdom ..... 108/153
1095938 12/1967 United Kingdom ..... 108/153
2143122 2/1985 United Kingdom ..... 108/153

*Primary Examiner*—David P. Bryant
*Attorney, Agent, or Firm*—Foley & Lardner

[57] ABSTRACT

A wire frame table for use in fabrication clean rooms is made of corrosion resistant material, minimizes particulate generation, and is modular in design. The wire frame table includes a frame which has an open top portion, a plurality of holes formed on two opposing support bars fastened to the open top portion and a plurality of projections formed underneath said frame. A wire frame which has a plurality of wire elements spaced substantially parallel to one another is inserted into the holes of the support bar to provide a wire frame surface. The wire frame table further includes a plurality of legs which are inserted onto the projections of the frame. A leveler for each of the legs provides a work surface of any desired angle. The modular nature of the design enables several wire frame tables to be aligned next to each other to give one continuous wire frame surface, or a multi-level surface by modifying the wire frame.

19 Claims, 4 Drawing Sheets

MODULAR WIRE FRAME TABLE AND METHOD OF ASSEMBLY

BACKGROUND OF THE INVENTION

1. Field of the Invention

The invention relates generally to a table and particularly to a modular wire frame table used in environments having stringent particle generation requirements such as a fabrication clean room.

2. Related Art

Fabrication clean rooms, for example fabrication rooms for manufacturing submicron wafers for computer microchips, have stringent requirements for particulate generation. Contamination of the manufacturing process from particulates has become a serious concern.

One of the ways to combat particulates in fabrication clean rooms is to use a wire frame table. The wire frame table has a surface made of wires to allow recirculated air to flow through the table surface. The wire surface suppresses turbulence which would otherwise be created as a result of air flow impinging on solid table tops. To further combat particulate generation, the wire frame table is constructed of stainless steel and is electro-polished or electro-plated to withstand corrosion from acid spills or fumes from acids.

In the wire frame tables currently used in fabrication clean room environments, the wires are welded onto the table frame. A problem with this construction is that solutions used during electro-polishing or electro-plating become entrapped in the spot-welding grooves and cause corrosion in the grooves afterwards. Consequently, dirt accumulates in the corroded grooves and eventually propagates into the surrounding environment. The table legs cause similar problems, because they too are welded onto the frame.

Still another problem with welding of the wires to the table frame is warpage during welding. With warpage, the wire frame table top is no longer even, especially because the amount of warpage varies from wire to wire. In order to provide a flat or an even work surface, the welding process must be scrutinized carefully for each weld and as a result, the process becomes prohibitively expensive.

SUMMARY OF THE INVENTION

An object of this invention is to provide a wire frame table which minimizes particulate generation.

Another object of the invention is to provide a wire frame table which is modular in design.

Still another object of the invention is to provide a wire frame table which provides a flat wire surface and is of low cost.

Still another object of the invention is to provide a method for assembling a wire frame table which minimizes particulate generation and is modular in design.

The above and other objects of the invention are accomplished with a modular table according to the invention which has an open rectangular frame having a top portion which defines a level top surface. A wire frame having a plurality of wire elements spaced parallel to one another is inserted into a support bar with matching holes, which is then fastened to the rectangular frame with screws.

Such an assembly does not require welding of the wire frame to the rectangular frame and allows electro-polishing or electro-plating of the wire frame and the rectangular frame to be conducted separately. As a result, solutions used during electro-polishing or electro-plating do not become entrapped in the grooves to cause corrosion and dirt accumulation therein. Particulate generation is thereby minimized.

Additional objects and advantages of the invention will be set forth in the description which follows. The objects and advantages of the invention may be realized and obtained by means of the instrumentalities and combinations particularly pointed out in the appended claims.

BRIEF DESCRIPTION OF THE DRAWINGS

The invention is described in detail herein with reference to the drawings in which.

DETAILED DESCRIPTION OF THE PREFERRED EMBODIMENTS

Figure 1:
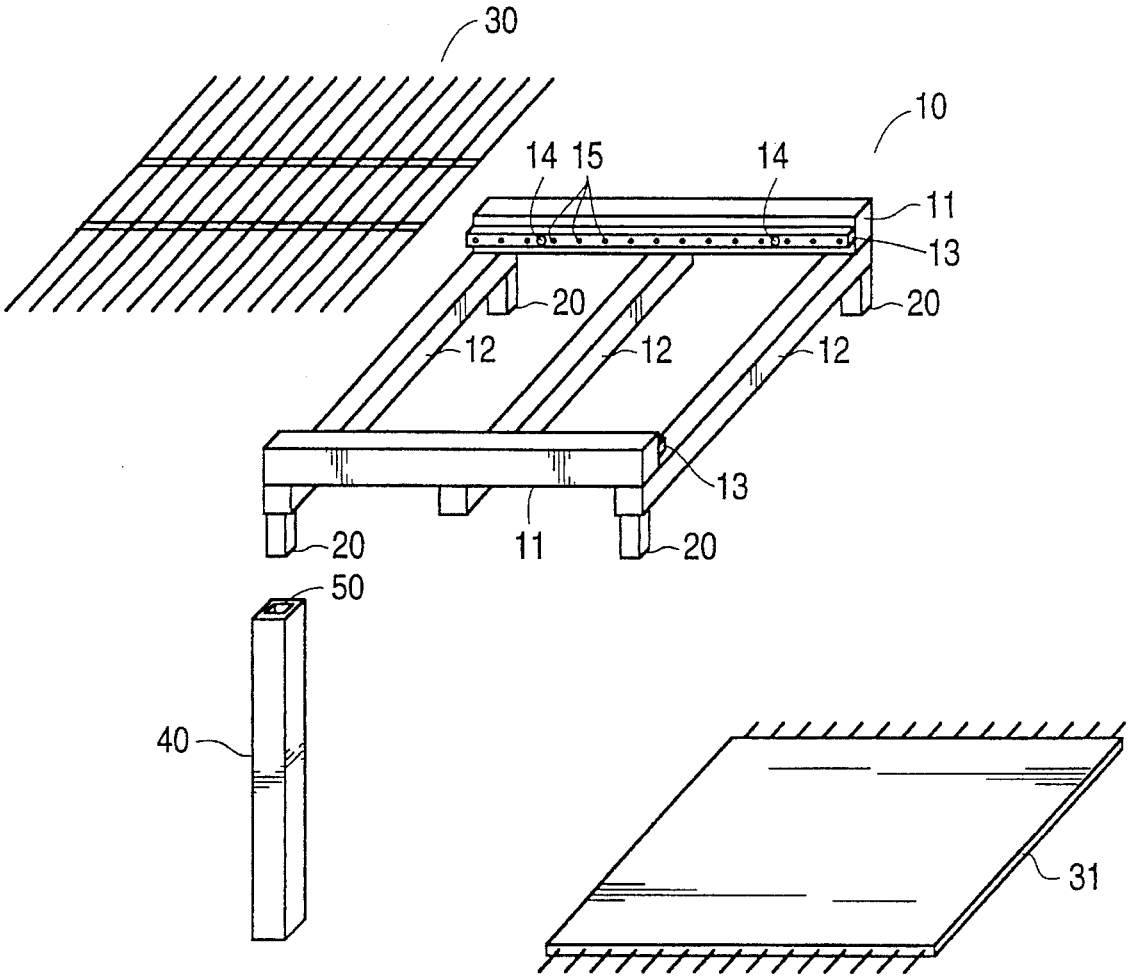
FIG. 1 is a perspective view of a wire frame table according to the invention.

FIG. 1 is a perspective view of a wire frame table according to the invention. A rectangular frame 10 is mounted atop a plurality of legs 40 (only one such leg is shown). The bottom portion of the frame 10 has a plurality of projections 20 and the legs 40 have hollow portions 50. The legs 40 support the frame 10 when the projections 20 are inserted into the hollow portions 50.

The frame 10 is formed by welding tubes 11 atop tubes 12. On opposing sides of tubes 11, wire mounting members 13, which have a plurality of holes 15 formed through them, are attached to the tubes 11 with screws 14, after member 13 is mounted to wire frame 30. A wire frame 30 having wires positioned substantially parallel to one another and to correspond to the holes 15 are inserted into the holes 15 to form an upper surface of the table according to the invention. In a slightly different embodiment, the wire frame table can be easily adapted to a solid top table by replacing the wire frame 30 with a solid frame 31.

Figure 2:
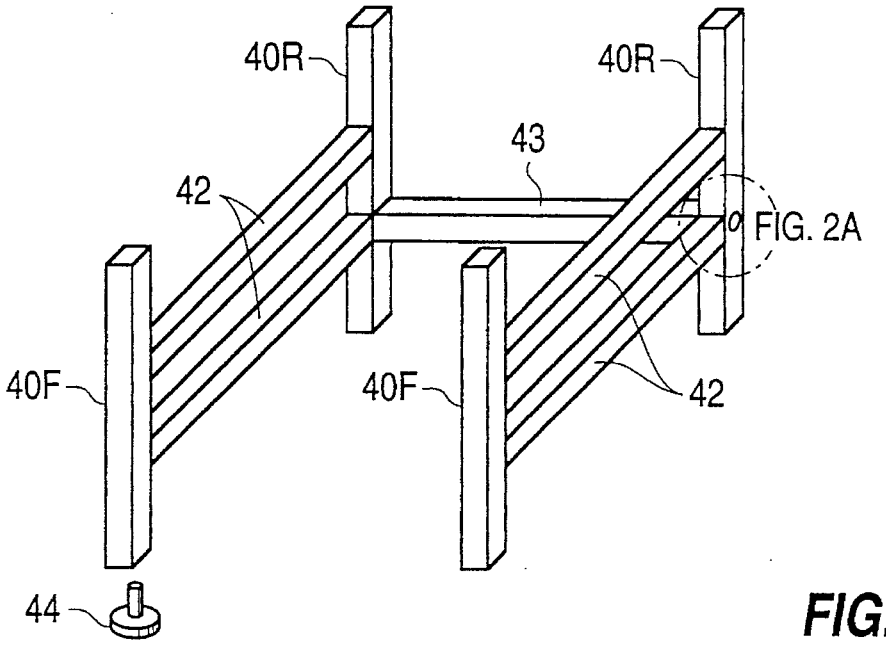
FIG. 2 is a front perspective view of the table leg assembly.
Figure 2A:
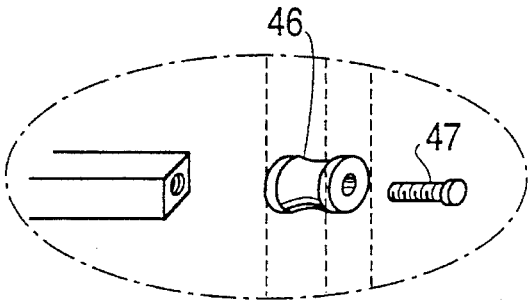

FIG. 2 is a perspective view of a table leg assembly. The assembly has dual right and left cross support members 42 and a single rear cross support member 43. The assembly does not have a front cross support member because the front is reserved as an open area where the operator can position his legs or a chair. Each end of the rear cross support member 43 is threaded. Each leg has a dumbbell-shaped member 46 welded into each of the rear legs 40R. A bolt 47 is inserted from the opposite side of the rear cross support member 43 and mates with the threaded end of the rear cross support member 43. The diameter of the bolt head 47 is smaller than the opening of the dumbbell-shaped member 46 such that the bolt 47 is housed within the rear leg 40R. A final element of the table leg assembly is a leveler 44 (only one is shown). The leveler 44 threads into each of the legs 40F and 40R and functions to level the work surface of the wire frame table.

Figure 3:
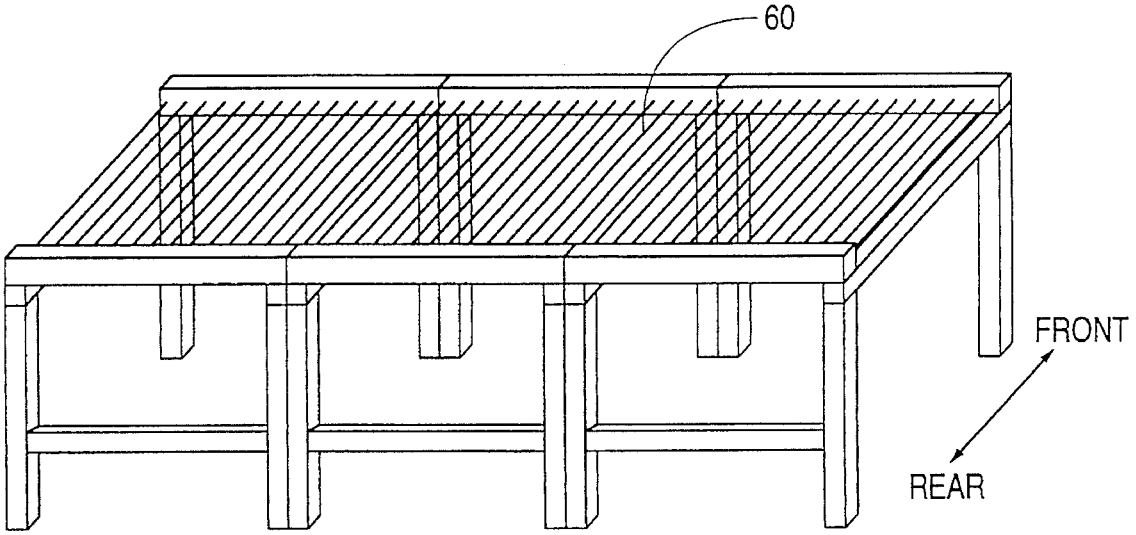
FIG. 3 is a rear perspective view which illustrates the modular nature of a wire frame table according to the invention.

FIG. 3 is a perspective view which illustrates the modular nature of a wire frame table according to the invention. By way of an example, three wire frame tables according to the invention are aligned next to one another in FIG. 3. The three tables provide one continuous wire frame surface 60.

One feature of the invention which makes possible the continuous wire frame surface 60 is the wire frame 30 which extends to the edges of the rectangular frame 10 (refer back to FIG. 1). The edges of the rectangular frame 10 do not cause any discontinuities in the wire frame surface 60. Consequently, when a second wire frame table is abutted adjacent to a first wire frame table, the spacing between the last wire of the first table and the first wire of the second table is substantially equivalent to the spacing between any two consecutive wires of the wire frame.

Another such feature according to the invention is the dumbbell-shaped mount for the rear cross support member 43 (refer back to element 46 of FIG. 2). Because the bolt 47 is housed within the dumbbell-shaped member 46 and also the rear leg 40R, a wire frame table can be positioned to abut an adjacent wire frame table without creating a gap between the two as shown in FIG. 3.

Figure 4:
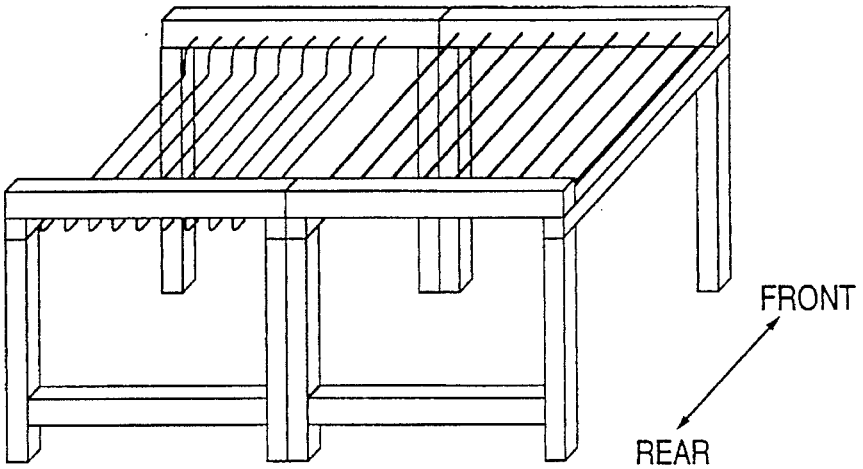
FIG. 4 is a rear perspective view which illustrates how the wire frame tables according to the invention can be adapted to different levels for the top, for various equipment installations.

Further, the modular nature of a wire frame table according to the invention can be adapted to have a multi-tiered surface. FIG. 4 illustrates a two-tiered work surface formed by two wire frame tables of different heights of work surface. This configuration can also be done on a single table by changing only half of the top 30.

Figure 5:
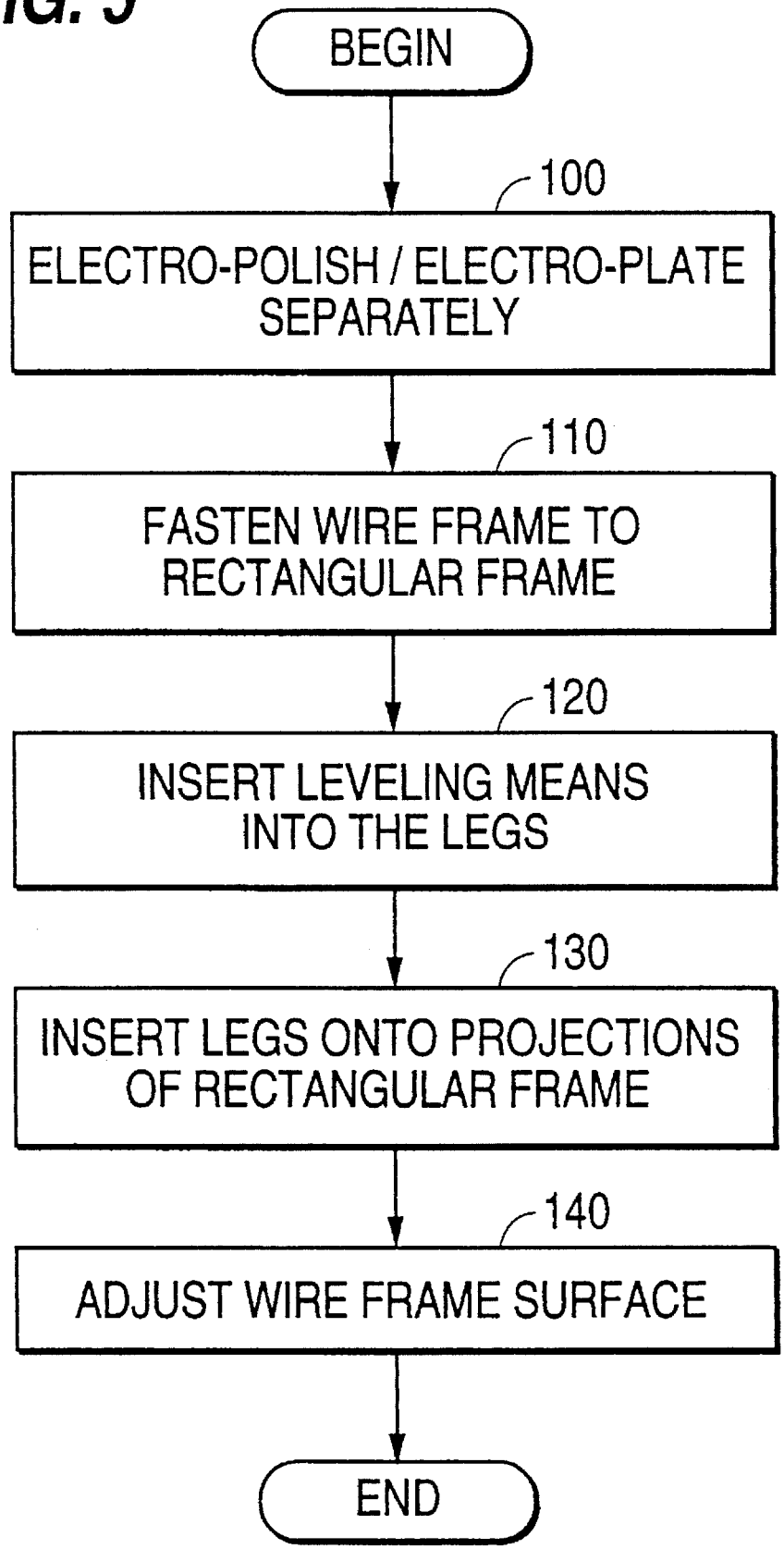
FIG. 5 is a diagram which depicts the steps of assembling a wire frame table according to the invention.

FIG. 5 is a diagram which depicts the steps of assembling a wire frame table according to the invention. The method steps of FIG. 5 assume that the components which make up the wire frame table are already available, similar in design to the components shown in FIG. 1, and made from stainless steel. In step 100, the components of the wire frame table including the frame, the wire frame, and the legs, are electro-polished or electro-plated separately. In step 110, the wire frame is inserted into the holes of the support bar 13 and then fastened to the frame member 11. In step 120, the levelers are threaded into the legs and in step 130, the legs are received into the projections formed underneath the frame, and rear support 43 fastened. Finally in step 140, the leveler is adjusted to obtain a level surface.

While particular embodiments according to the invention have been illustrated and described above, it will be clear that the invention can take a variety of forms and embodiments within the scope of the appended claims.

I claim:

1. A wire frame table comprising:

a frame having an open top portion and a plurality of holes formed on two opposing sides of the open top portion; and a wire frame having a plurality of wire elements spaced substantially parallel to one another and to correspond to said holes, the wire elements inserted into said holes to secure said wire frame to said frame, wherein said wire frame defines a top surface of said wire frame table.

2. A wire frame table as recited in claim 1, further comprising support bars attached to two opposing sides of the open top portion, wherein said holes are formed on said support bars.

3. A wire frame table as recited in claim 2, further comprising:

a plurality of projections formed underneath said frame; and a plurality of legs having top portions adapted to receive said projections.

4. A wire frame table as recited in claim 3, wherein said frame has a rectangular top portion.

5. A wire frame table as recited in claim 4, wherein said projections are formed underneath corners of said rectangular top portion.

6. A wire frame table as recited in claim 5, further comprising a rear, a left, and a right cross support member attached to and between corresponding legs.

7. A wire frame table as recited in claim 6, wherein each of said legs attached to said rear cross support member has a bore therethrough, each of said bores adapted to receive a bolt therethrough for attachment to said rear cross support member.

8. A wire frame table as recited in claim 7, wherein each of said legs includes leveling means adapted for insertion into said legs for adjusting an angle of said top surface.

9. A wire frame table as recited in claim 5, wherein said frame, said wire frame, and said legs are constructed of stainless steel.

10. A wire frame table as recited in claim 9, wherein said frame, said wire frame, and said legs are treated with one of electro-polishing and electro-plating.

11. A wire frame table comprising:

a rectangular frame having front and rear tubings affixed atop left and right tubings, said front and rear tubings each having a support bar attached thereto, said support bar having a plurality of holes;

a wire frame having a plurality of wire elements spaced substantially parallel to one another and to correspond to the holes of said support bars, the wire elements inserted into the holes of said support bars to secure said wire frame to said rectangular frame, said wire frame defining a top surface of said wire frame table;

projections formed underneath corners of said rectangular frame; and legs having top portions adapted to receive said projections.

12. A wire frame table as recited in claim 11, wherein each of said legs includes leveling means adapted for insertion into said legs for adjusting an angle of said top surface.

13. A wire frame table as recited in claim 11, wherein said rectangular frame, said wire frame, and said legs are constructed of stainless steel.

14. A wire frame table as recited in claim 13, wherein said rectangular frame, said wire frame, and said legs are treated with one of electro-polishing and electro-plating.

15. A method of assembling a wire frame table comprising a frame having an open top portion, a plurality of holes formed on two opposing support bars attached to the open top portion and a plurality of projections formed underneath said frame, a wire frame having a plurality of wire elements spaced substantially parallel to one another and to correspond to the holes of said support bar, and a plurality of legs having top portions adapted to receive said projections of said frame, said method comprising the steps of:

(a) treating said frame, said wire frame, and said legs separately with one of electro-polishing and electro-plating;

(b) inserting said wire frame into said holes of said support bar; and (c) engaging said legs with said projections of said frame, wherein said frame, said wire frame, and said legs are made from stainless steel.

16. A method of assembling a wire frame table as recited in claim 15, wherein said wire frame table further comprises levelers adapted for insertion into each of said legs, said method further comprising the steps of:

(d) inserting said levelers into said legs; and (e) adjusting an angle of said top surface using said levelers.

17. A method of assembling a wire frame table as recited in claim 16, further comprising the steps of:

(f) repeating steps (a) through (d) for a second wire frame table; and (g) aligning said second wire frame table next to said wire frame table such that the wire elements of said second Wire frame table are parallel to the wire elements of said wire frame table; and (h) adjusting an angle of said top surface of said second wire frame table such that said wire elements of said wire frame table and said second wire frame table are spaced continuously and evenly from one end of said wire frame table to an opposite end of said second wire frame table.

18. A method of assembling a wire frame table as recited in claim 17, further comprising the steps of:

(i) repeating steps (a) through (d) for a desired number of additional wire frame tables; and (j) repeating steps (g) and (h) for said additional wire frame tables.

19. A method of assembling a wire frame table as recited in claim 15, further comprising the step of modifying a top surface of said table to different levels by changing a configuration of said wire frame.

* * * * *